United States Patent [19]

Mancuso

[11] Patent Number: 4,629,191

[45] Date of Patent: Dec. 16, 1986

[54] GOLF CLUB INCLUDING PENTAGONAL GRIP

[76] Inventor: Joseph J. Mancuso, 30 S. Woodbury Rd., Pitman, N.J. 08071

[21] Appl. No.: 751,956

[22] Filed: Jul. 5, 1985

[51] Int. Cl.[4] ..... A63B 53/14

[52] U.S. Cl. ..... 273/81.4; 273/81 B

[58] Field of Search ..... 273/81 B, 81.4, 165, 273/81 R, 81 A, 81 C, 81 D, 73 J, 75, 67 DA; D21/214, 217, 218, 219, 220, 222

[56] References Cited

U.S. PATENT DOCUMENTS 1,551,203 8/1925 Mills ..... 273/81 B 3,219,348 11/1965 Dishner ..... 273/81 B X

FOREIGN PATENT DOCUMENTS 20882 of 1908 United Kingdom ..... 273/81 B

*Primary Examiner*—George J. Marlo

*Attorney, Agent, or Firm*—Norman E. Lehrer

[57] ABSTRACT

A hand grip comprised of an elastomeric material is coaxially secured to the end of a golf club shaft. The grip includes five flat gripping surfaces which extend longitudinally over a substantial length and which are equally spaced around the grip. The outer surface of the grip formed by the gripping surfaces has a substantially regular pentagonal cross section. One of the flat surfaces is located on the upper surface of the grip to directly underlie the golfer's thumbs when properly gripping the club.

6 Claims, 6 Drawing Figures

GOLF CLUB INCLUDING PENTAGONAL GRIP

BACKGROUND OF THE INVENTION

The present invention is directed toward a golf club handle or grip and more particularly toward a five-sided grip.

As is well known to those skilled in the art, it is essential that a golf club be properly gripped not only when addressing a ball but throughout the entire swing. While this is normally not a difficult problem for healthy professional golfers, amateur golfers may frequently grip a club incorrectly or may fail to maintain the grip during the swing. Furthermore, golfers with minor arthritic or similar debilitating conditions may have difficulty in maintaining a proper hold on the golf club.

Attempts have been made in the past to provide a golf club with a grip which is designed to guide a golfer's hands into a proper position and to help maintain the same in that position. Examples of such proposed grips are shown in U.S. Pat. Nos. 1,528,648; 1,532,679; 1,677,099; 1,967,999; 1,994,556; 2,088,008; 2,877,018; 3,198,520; 4,116,440; D 128,266 and in British Patent No. 201,621. To the best of Applicant's knowledge, none of the grips shown in the foregoing patents have met with any commercial success. Some of these grips have relatively complex configurations which make them difficult and expensive to produce and assemble on a golf club shaft. Others have simpler configurations but apparently do not function satisfactorily.

SUMMARY OF THE INVENTION

The present invention is intended to overcome the deficiencies of the prior art and to provide a grip or handle for a golf club which aids the golfer in properly positioning his hands and which aids him in maintaining the proper position throughout the swing even though the golfer may have an arthritic or similar condition. The grip according to the present invention is comprised of an elastomeric material which is coaxially secured to the end of a golf club shaft. The grip includes five flat gripping surfaces which extend longitudinally over a substantial length and which are equally spaced around the grip. The outer surface of the grip formed by the gripping surfaces has a substantially regular pentagonal cross section. One of the flat surfaces is located on the upper surface of the grip to directly underlie the golfer's thumbs when properly gripping the club.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
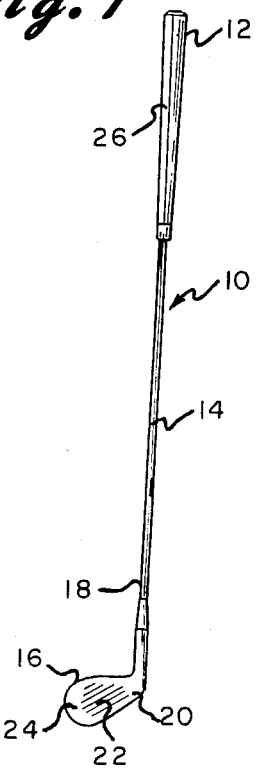
FIG. 1 is a side elevational view of a golf club having a grip constructed in accordance with the principles of the present invention.
Figure 2:
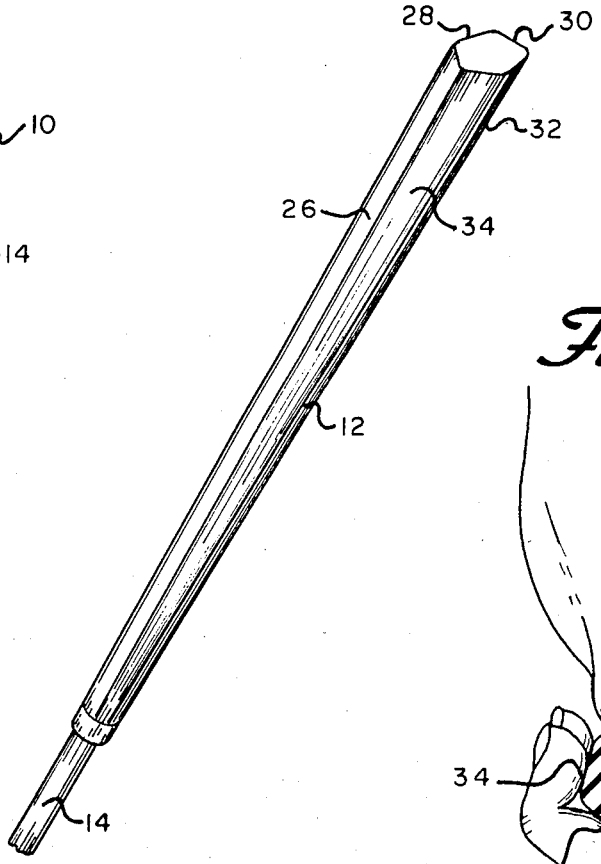
FIG. 2 is a perspective view of the golf club grip taken from the top of FIG. 1.

Referring now to the drawings in detail wherein like reference numerals have been used throughout the various figures to designate like elements, there is shown in FIG. 1 a golf club constructed in accordance with the principles of the present invention and designated generally as 10. With the exception of the grip 12 which will be described in more detail hereinafter, the golf club 10 is generally of conventional construction. The golf club 10 is comprised of an elongated shaft 14 having a club head 16 extending laterally from the front surface 18 of the lower end of the shaft 14. The head 16 has its heel 20 connected to the front surface 18 of the shaft and has a ball striking face 22 between its heel 20 and the toe 24 which is remote from the shaft 14.

The foregoing description of the club head 16 and the manner in which it is attached to the shaft 14 is, of course, conventional. It has been included herein primarily for orientation purposes with respect to the grip 12 which will become more apparent hereinafter. The surface 18 has been referred to as the front surface for convenience only. The surface of the shaft 14 is, of course, continuous. What is meant by the front surface is the radially aligned portion from which the club head 16 extends. Furthermore, while the club head 16 is shown in FIG. 1 as being an iron, it should be readily apparent that the present invention is also applicable to a putter or a wood.

The hand grip 12 which is comprised essentially of an elastomeric material is secured coaxially to the upper end of the shaft 14. As shown most clearly in FIGS. 2, 3, 4 and 6, the grip 12 is comprised of five relatively flat gripping surfaces 26, 28, 30, 32 and 34 which extend longitudinally of the grip 12 along the entire length or at least a major portion thereof. These flat surfaces are substantially identical to each other and are equally spaced around the outer periphery of the grip 12 such that the cross-sectional shape of the outer surface is substantially pentagonal throughout the length thereof.

Figure 3:
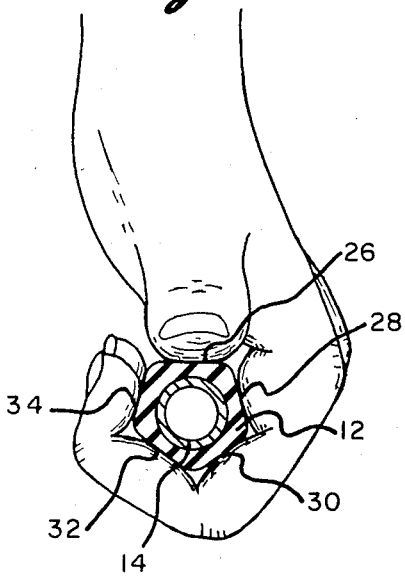
FIG. 3 is a cross-sectional view of one embodiment of the invention and showing the manner in which the grip is held in a golfer's hand.

In order to ensure that the grip 12 is properly held, one of the flat surfaces such as surface 26, is located on the front surface 18 of the shaft 14. That is, the club 16 extends forwardly and substantially perpendicular to the plane of the surface 26. As shown in FIG. 3, when the golf club grip is properly held, the golfer's thumb is positioned over the flat surface 26 and the joints of the golfer's fingers naturally fit around the grip and overlie the surfaces 28, 30, 32 and 34. Thus, the pentagonal shape not only helps to position the golfer's hand but because of the natural fit, tends to maintain that position with less force or effort on the part of the golfer. As a result, even a golfer with a minor arthritic or similar condition can maintain a proper hold.

The outer pentagonal shape of the grip 12 can be accomplished in several different ways. The first embodiment of the invention is shown in FIG. 3. In this embodiment, the portion of the shaft 14 around which the grip 12 fits is circular in cross section. The inner surface of the grip 12 is also circular in cross section but the outer surface is preformed into the desired pentagonal shape.

Figure 4:
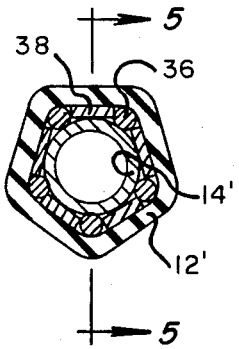
FIG. 4 is a cross-sectional view showing a second embodiment of the invention.
Figure 5:
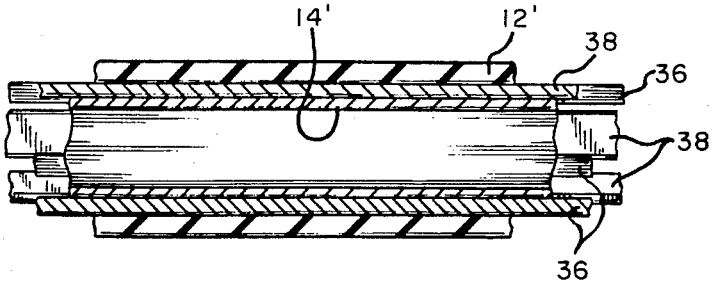
FIG. 5 is a cross-sectional view taken through the line 5—5 of FIG. 4.

In the embodiment shown in FIGS. 4 and 5, the elastomeric grip 12' is normally of circular cross section throughout. That is, both the inner surface and outer surface normally are circular. This grip is also applied to a shaft 14' having a circular cross section. The pentagonal shape is formed by a plurality of inserts which are comprised of five elongated rods 36 equally spaced around the perimeter of the shaft 14' between the outer surface of the shaft 14' and the inner surface of the grip 12'. Located between adjacent pairs of rods 36 are elongated rectangularly shaped filler members 38. The length of the insert means comprised of the rods 36 and filler members 38 are substantially equal to the overall length of the grip 12' so that the pentagonal shape of the outer surface of the grip 12' extends throughout the length thereof.

Figure 6:
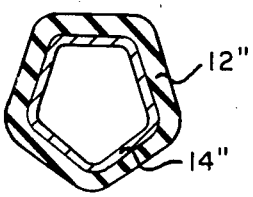
FIG. 6 is a cross-sectional view of a third embodiment of the invention.

The grip 12'' shown in FIG. 6 also normally has a circular cross section. In this embodiment of the invention, the shaft 14'' is preformed into a pentagonal shape so that when the grip 12'' is applied thereto the outer surface thereof also takes on a pentagonal shape. It should be apparent to those skilled in the art that this particular embodiment would only be useful with new constructions of golf clubs wherein the shaft can be preformed into the desired shape. The first and second embodiments of the invention discussed above may be used with either new golf clubs or can be used to regrip existing clubs.

The present invention may be embodied in other specific forms without departing from the spirit or essential attributes thereof and accordingly reference should be made to the appended claims rather than to the foregoing specification as indicating the scope of the invention.

I claim:

1. In a golf club having a shaft with a club head extending laterally from the front surface of one end thereof, said head being connected at its heel to said front surface of said shaft and having a ball striking face between its heel and a toe remote from said shaft, a hand grip comprised of an elastomeric material secured coaxially to the other end of said shaft, said grip being comprised of five relatively flat gripping surfaces extending longitudinally of the grip along a major portion thereof, said five flat surfaces being substantially equally spaced around said grip such that the cross-sectional shape of the outer surface of said grip is a substantially regular pentagon throughout said major portion thereof and one of said flat gripping surfaces being on the front surface of said shaft.

2. The invention as claimed in claim 1 wherein the end of said shaft underlying said elastomeric grip is pentagonal in cross section.

3. The invention as claimed in claim 1 wherein the end of said shaft underlying said elastomeric grip is circular in cross section.

4. The invention as claimed in claim 3 wherein said grip is tubularly shaped, the inner surface thereof being of circular cross section and the outer surface being of pentagonal cross section.

5. The invention as claimed in claim 3 wherein said grip is tubularly shaped and when in its natural state, before being attached to said shaft, both the inner and outer surfaces have a circular cross section and wherein insert means located between said shaft and said grip impart the pentagonal shape to the outer surface of said grip.

6. The invention as claimed in claim 5 wherein said insert means is comprised of a plurality of elongated inserts.

* * * * *